US006627801B2

(12) United States Patent
Casamento

(10) Patent No.: US 6,627,801 B2
(45) Date of Patent: Sep. 30, 2003

(54) FINISH PROTECTION DEVICE FOR STRINGED MUSICAL INSTRUMENTS

(76) Inventor: Michael John Casamento, 32 Varsity Blvd., East Setauket, NY (US) 11733

( * ) Notice: Subject to any disclaimer, the term of this patent is extended or adjusted under 35 U.S.C. 154(b) by 0 days.

(21) Appl. No.: 09/834,263

(22) Filed: Apr. 12, 2001

(65) Prior Publication Data

US 2003/0140763 A1 Jul. 31, 2003

(51) Int. Cl.[7] ..... G10D 3/00
(52) U.S. Cl. ..... 84/290; 84/291
(58) Field of Search ..... 84/290, 291, 329; 206/14, 314

(56) References Cited

U.S. PATENT DOCUMENTS 3,251,258 A 5/1966 Parker
3,309,954 A 3/1967 Phillips et al.
3,877,501 A 4/1975 Toth
4,000,678 A 1/1977 Messina
4,084,477 A 4/1978 Dominguez
4,601,391 A 7/1986 Gibbs et al.
5,594,191 A * 1/1997 Epstein et al. ..... 84/485 R

* cited by examiner

*Primary Examiner*—Kimberly Lockett

(57) ABSTRACT

A device for protecting the finish applied to the wood and other component parts of certain stringed musical instruments is provided, comprising a device fabricated from a sheet of highly plasticized vinyl film, appropriately sized and shaped so as to conform to the area requiring protection. Once applied, the device forms a second skin over the finish thereby preventing damage from abrasion, and other harmful elements such as skin oils, and perspiration. The self adherent properties of the material allow the device to be attached to the instrument without fasteners or adhesives. The device may be repeatedly applied and removed without damage to the instrument's finish, or degradation in its adhesive qualities. In addition, the device is inherently strong, thin, flexible, and extremely light in weight, preventing any adverse affects on the original looks, feel, and tonal qualities of the instrument.

3 Claims, 1 Drawing Sheet

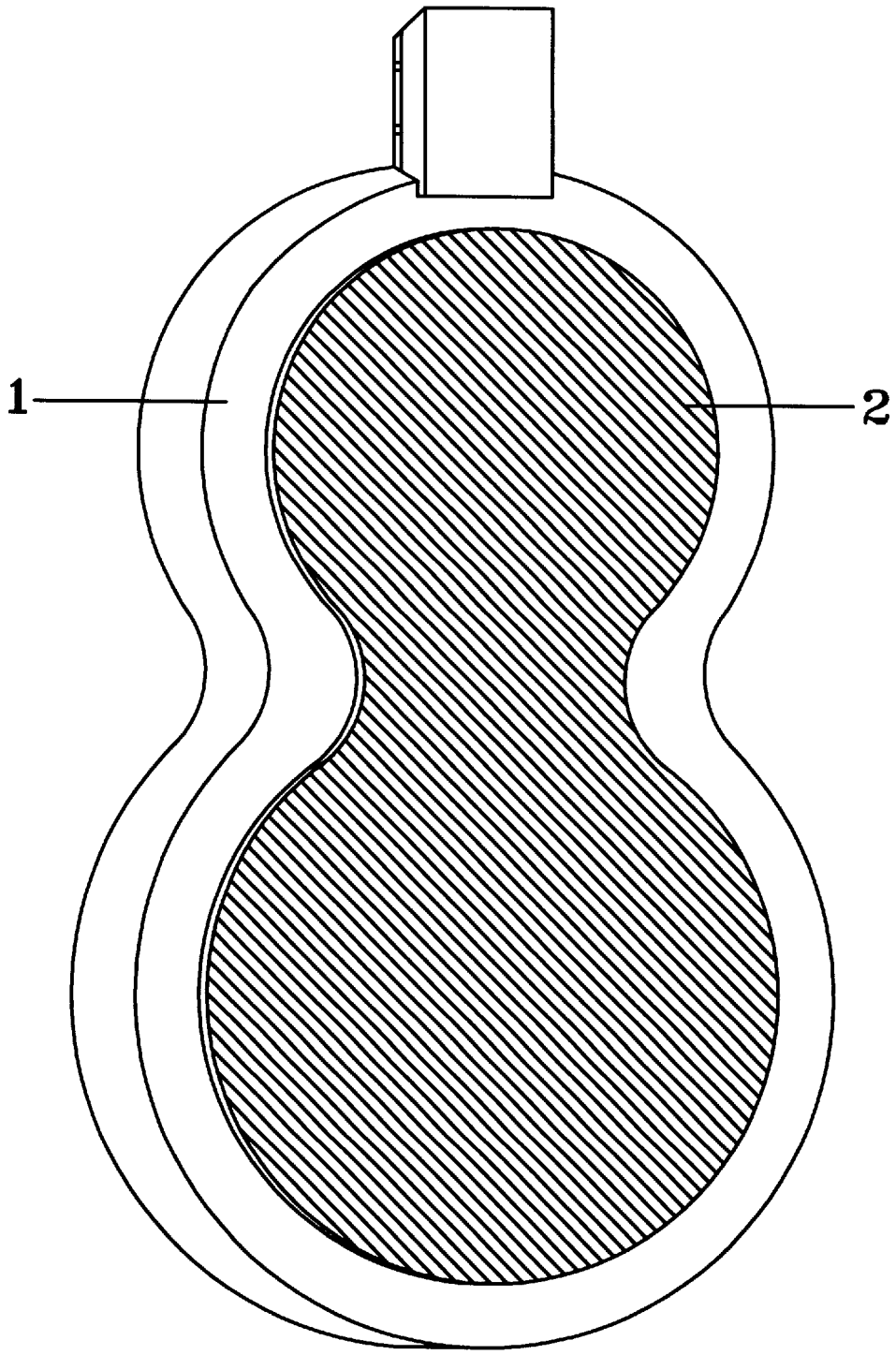
1
2

FINISH PROTECTION DEVICE FOR STRINGED MUSICAL INSTRUMENTS

BACKGROUND OF THE INVENTION

This invention relates to providing an effective means of protecting the finish applied to the wood and various component parts of stringed musical instruments.

The many finishes applied to a stringed musical instrument not only contribute to its beauty, but serve to protect the delicate elements out of which the instrument is constructed. Metal parts are often plated with such elements as chrome, nickel or even gold, while wooden areas are painstakingly finished with paint, stain, lacquer, and varnish. Over time, the finish applied to these elements will undoubtedly be exposed to the detrimental effects of abrasion, and other harmful elements such as skin oils, and perspiration.

The very nature of playing a stringed instrument often necessitates repetitive movements across the finished surfaces subjecting them to abrasive damage. Articles of clothing worn by the player such as buttons, belt buckles, and jewelry also possess the propensity to cause damage to the finish. In addition, certain areas of the instrument may come into frequent contact with the skin of the player, exposing them to harmful elements such as skin oil, and perspiration.

Previous inventions in this field have been targeted primarily towards protecting the finish of the wood, and often consist of some type of padding or fabric cover that is affixed to the surface of the instrument over the area of concern.

U.S. Pat. No. 5,103,709 to Richard Foss Jr. describes a device consisting of a pliable fabric pad attached to a rigid sub-layer. This assembly is then attached to the instrument by means of Velcro fasteners. This device will conceal the finish and thereby alter the appearance of the instrument. In addition, fastening devices must be attached to the finish, which will remain in place even when the device is removed. The padding may also alter the tonal quality of the instrument.

U.S. Pat. No. 4,601,391, issued to Gibbs et al is another form of a fabric-based protector. The Gibbs et al device is designed to protect only the rear of the instrument. It must be constructed to fit the shape of the instrument, which makes it difficult to accommodate the large variation in the styles and shapes of musical instruments. It will greatly alter the appearance of the instrument, and since it is made from a flexible fabric, friction can occur as the device moves over the surface of the instrument thereby promoting wear.

U.S. Pat. No. 4,084,477 to Richard Lee Dominguez describes a device designed to standoff from the surface of the instrument thereby preventing dust and debris from accumulating between the finish and the device. Hook and loop fasteners are used to attach the device to the surface of the instrument. The design of this device may help to reduce any adverse affects on tonal quality, as well as the abrasive affects of debris caught between the device and the instrument, however, the feel and looks of the instrument would be greatly altered. In addition, fastening devices must be attached to the finish, which will remain in place even after the device is removed.

All of these referenced devices are primarily designed to protect the wood finish on the rear surface of the instrument. The bulkiness of their construction and attachment methods tends to prohibit them from being a practical solution for protecting other areas of the instrument or component parts, such as but not limited to, the pick guard, tailpiece, and bridge. It is also difficult to size and shape these devices to conform to the varied contours of different instruments.

BRIEF SUMMARY OF THE INVENTION

This invention relates to a device fabricated from a sheet of highly plasticized vinyl film, which is designed to prevent damage to the finished surfaces of the wood and other component parts of certain stringed musical instruments.

One feature of the invention briefly stated is, a device comprising a sheet of highly plasticized vinyl film, which conforms to the size and shape of the surface being protected. Once applied, the device will form a second skin over the finish, thereby protecting the finish from exposure to abrasion, and other harmful elements such as skin oils, and perspiration.

The vinyl film material of the present invention is most commonly manufactured from a base consisting of Poly Vinyl Chloride (PVC) to which a large amount of plasticizer (a liquid) has been added. This highly plasticized formulation is spread into a thin film which is then smoothed (calendared) to a high gloss finish. The plasticizer continuously migrates to the surface of the film creating a self renewing bonding surface, enabling the material to adhere to any smooth non-porous surface via chemical interaction without the aid of an adhesive. The material may also be applied and removed countless times without degrading its adhesive qualities.

Constructing the device out of such a material will facilitate its adhesion directly to the surface of the instrument, forming a second skin with virtually no gaps between which dust and debris can become trapped. In addition, the propensity for the device to move about over the finish contributing to abrasive wear is completely eliminated.

The material is readily available in either clear or solid colorations. The translucent qualities of the clear material would allow the beauty of the underlying finish to be visible, providing protection to the concerned area without altering the appearance of the instrument. The solid colorations can be utilized to facilitate the concealment of finish imperfections on older instruments while preventing further damage.

The device will be inherently strong, thin, flexible, and extremely light in weight. It will adhere directly to the surface of the instrument without the use of fasteners or adhesives. As a result, the playability of the instrument with respect to its original looks, feel and tonal qualities will not be adversely affected. The device may be repeatedly applied and removed without damage to the instrument's finish, or degradation to the adhesive qualities of the device itself.

DESCRIPTION OF THE DRAWING FIGURES

FIG. 1—Depicts the device applied to the rear surface of an acoustic guitar.

LIST OF REFERENCE NUMERALS USED IN THE DRAWINGS

1—a stringed musical instrument
2—the device element

DETAILED DESCRIPTION OF THE INVENTION

Referring to FIG. 1, the depicted stringed musical instrument 1 shows the rear surface of an acoustic guitar. In its preferred embodiment, the invention comprises a device element 2 fabricated from a sheet of highly plasticized vinyl film. This material will adhere to any smooth non-porous surface, and can be easily removed without damage to the material, or the surface to which it is adhered. The device element 2 is made to conform to the shape and size of the protected area, after which it is aligned, and placed in contact with the surface of the stringed musical instrument 1. Pressure is then applied to the surface of the device element 2 to promote adhesion. Once applied, the device element 2 will remain firmly affixed to the surface of the stringed musical instrument 1 with virtually no movement or gaps between the finish and the device element 2. Removal of the device element 2 is facilitated by lifting the device element 2 in a direction perpendicular to the surface of the stringed musical instrument 1.

Although the above description includes much specificity, this should not be construed as limitations on the scope of the invention, but as merely providing an illustration of the preferred embodiment. Thus, the scope of the invention should be determined by the appended claims and their legal equivalents, rather than by the examples given.

I claim:

1. A device for protecting the finished surfaces of a stringed musical instrument having a neck, said neck being rigidly affixed to a body, said body having a front, a side, and a rear surface, comprising:

a. a protective element consisting of a self adherent sheet of highly plasticized vinyl film, b. said protective element having a means for attaching via chemical interaction the protective element to the surface of said stringed musical instrument, c. said protective element being of sufficient size so as to provide adequate coverage to the surface of said stringed musical instrument, d. said protective element being shaped so as to conform to the surface of said stringed musical instrument, e. said protective element being of sufficient thickness so as to remain flexible.

2. The device of claim 1 wherein said protective element is appropriately sized and shaped to conform to the rear surface of the body of said stringed musical instrument.

3. The device of claim 2 wherein said stringed musical instrument is selected from the group consisting of guitars and basses.

* * * * *